United States Patent [19]

Finn

[11] Patent Number: 4,920,593

[45] Date of Patent: May 1, 1990

[54] COMBINATION TOOL

[76] Inventor: Patrick W. Finn, 1400 Seminole Rd., Algonquin, Ill. 60102

[21] Appl. No.: 356,507

[22] Filed: May 25, 1989

[51] Int. Cl.[5] ..... B25B 7/22

[52] U.S. Cl. ..... 7/127; 81/319; 81/326; 81/426.5

[58] Field of Search ..... 7/125, 127; 81/418, 81/426.5, 324–326, 318, 319

[56] References Cited

U.S. PATENT DOCUMENTS

| | | | |
|---|---|---|---|
| 389,203 | 9/1888 | Crane . | |
| 445,972 | 2/1891 | Caldwell . | |
| 606,591 | 6/1898 | Slack . | |
| 841,602 | 1/1907 | Taylor | 81/326 |
| 942,549 | 12/1909 | Cronk | 81/426.5 X |
| 971,582 | 10/1910 | Ball | 81/326 |
| 1,069,106 | 8/1913 | Brice | 81/426.5 X |
| 1,188,380 | 6/1916 | Arthur . | |
| 1,251,228 | 12/1917 | Hartzman | 81/318 |
| 1,418,312 | 6/1922 | Loftus . | |
| 1,661,365 | 3/1928 | Gendron | 81/426.5 X |
| 1,678,313 | 7/1928 | Atkinson | 81/318 X |
| 2,819,633 | 1/1958 | Boehnke | 7/127 X |
| 3,744,069 | 7/1973 | Grebow . | |

FOREIGN PATENT DOCUMENTS

| | | | |
|---|---|---|---|
| 1064990 | 12/1953 | France | 7/127 |

*Primary Examiner*—James G. Smith

*Attorney, Agent, or Firm*—Mathew R. P. Perrone, Jr.

[57] ABSTRACT

A hand tool of the pliers type has a screwdriver tip at the end of each handle of the pliers with a locking device for locking the pliers in open position to provide a handle for the screwdriver from the other arm of the pliers, while providing a nail pulling capability.

8 Claims, 2 Drawing Sheets

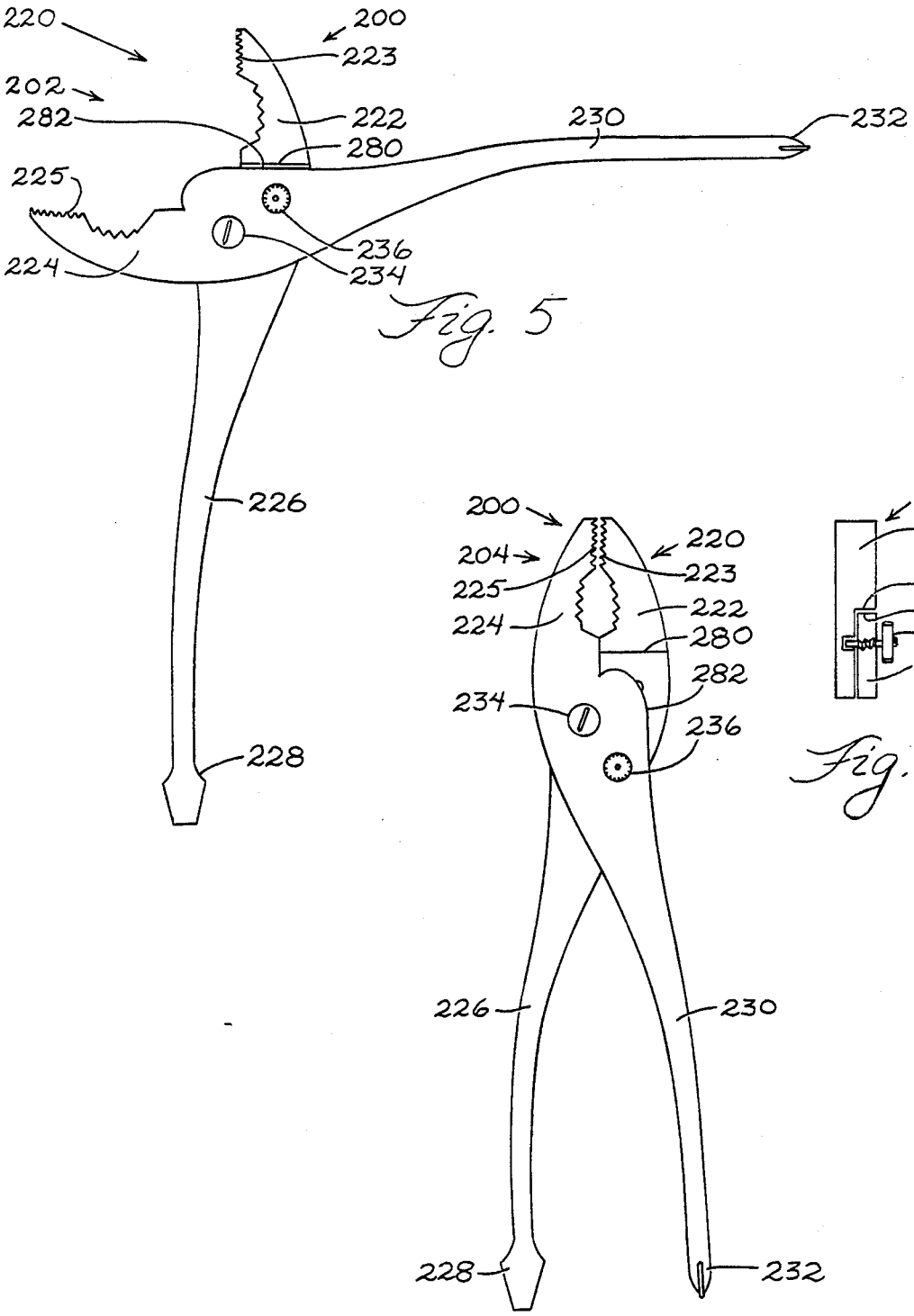
Fig. 5
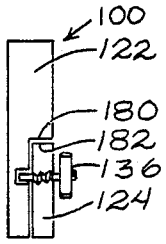
Fig. 7
Fig. 6

COMBINATION TOOL

BACKGROUND OF THE INVENTION

This application relates to a hand tool and more particularly to a hand tool of the pliers type having a screwdriver tip at the end of each handle of the pliers with a locking device for locking the pliers in open position to provide a handle for the screwdriver from the other arm of the pliers, while providing a nail pulling capability.

It is highly desirable to provide combination tools. However, use of combinaton tools can result in a complicated set up which destroys the efficiency of the tool involved. It is highly desirable for a compound tool to be easily used with other components and easily transferred from the use of one element of the compound tool to another element.

Furthermore, there is great difficulty in having each element locked into position for efficient use of each element of the compound tool. If the locking cannot be accomplished efficiently, the tool is inefficient.

If these factors can be accomplished efficiently, the advantages of having a compound tool are equivalent to each tool individually while retaining the advantages of having more than one tool available immediately.

SUMMARY OF THE INVENTION

Accordingly, among the many objects of this invention is to provide a hand tool in the form of a set of pliers capable of being fixed in position so that a screwdriver tip on the end of each handle of the pliers may be used efficiently.

A further objective of this invention is to provide a pliers capable of pulling nails.

A still further objective of this invention is to provide a pliers having a screwdriver tip at the end of a handle.

Yet a further objective of this invention is to provide a pliers having a phillips screwdriver tip at the end of a handle.

Another objective of this invention is to provide a pliers having a flat blade screwdriver tip at the end of a handle.

Yet another objective of this invention is to provide a pliers having a locking mechanism to fix the handle of the pliers.

These and other objectives of this invention are met by providing a pliers with a screwdriver tip at the end of each handle, a nail puller in the jaws of the pliers and a locking mechanism to hold the jaws in a predetermined position.

BRIEF DESCRIPTION OF THE DRAWINGS

FIG. 5 is a front view of slip pliers 200 having a phillips screwdriver tip 232 and a flat screwdriver tip 228 thereon in open position 202.

FIG. 6 is a front view of slip pliers 200 in closed position 204.

FIG. 7 is a cross-section of FIG. 1 along Line 7—7.

Throughout the Figures of the drawing, where the same part appears in more than one Figure of the drawing, the same number is applied thereto.

DESCRIPTION OF THE PREFERRED EMBODIMENTS

A pliers having a screwdriver tip at the end of each handle and a locking mechanism for positioning the handles at a substantially ninety (90°) degree angle from each other. In this fashion, one handle of the pliers can become a handle for operating the screwdriver, while the other handle serves as a screwdriver. The screwdriver may be a flat bladed screwdriver, a phillips screwdriver, a star screwdriver or any other suitable screwdriver.

Figure 1:
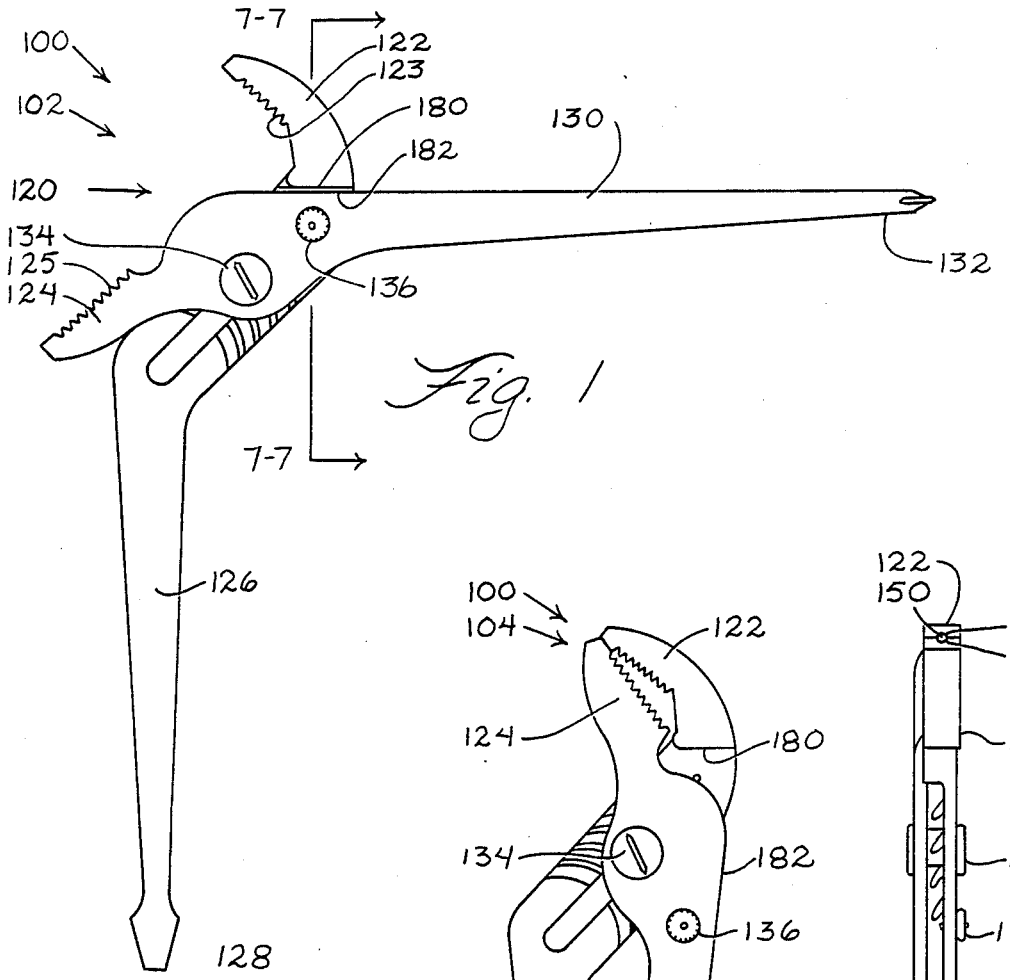
FIG. 1 is a front view of crescent (also known as arc joint) pliers 100 having a phillips screwdriver tip 132 and a flat screwdriver tip 128 thereon in open position 102.
Figure 3:
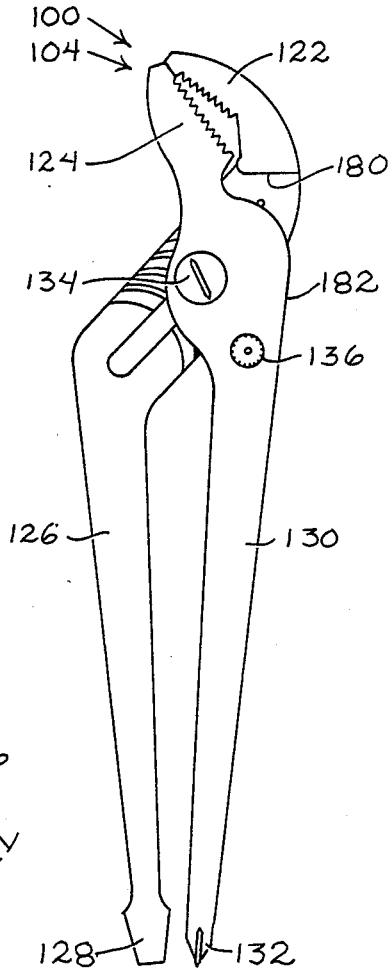
FIG. 3 is a front view of crescent pliers 100 in closed position 104.

Referring now to FIG. 1 and FIG. 3, the crescent pliers 100 include a standard slide angle jaw 120 having a first jaw side 122 and a second jaw side 124 for the purpose of gripping a desired element. Crescent pliers 100 are also known as arc pliers. First jaw side 122 extends from a first jaw gripper 123 into a first handle 126. First jaw gripper 123 is thus at one end of first jaw side 122; while, at the other end of the first jaw side 122, is a flat blade screwdriver 128.

By the same token, second jaw side 124 extends from a second jaw gripper 125 into a second handle 130. Second jaw gripper 125 is thus at one end of second jaw side 124 while, at the other end of the second jaw side 124 on second handle 130 is a phillips screwdriver 132. Second jaw gripper 125 and first jaw gripper 123 serve to grip desired items.

Situated on second jaw 124 adjacent crescent pivot 134 is a rotatable jaw nut 136 secured thereto. The rotatable jaw nut 136 is large enough to be turned by hand and can be used in threaded relation with second jaw 124 and threadably moved downwardly to contact first jawside 122 in order to lock the crescent pliers 100 in appropriate position to use either flat blade screwdriver 128 or phillips screwdriver 132.

In this fashion, the desired results can be achieved of providing a method of positioning the crescent pliers 100 so that either the flat blade screwdriver 128 or phillips screwdriver 132 may be used.

Figure 2:
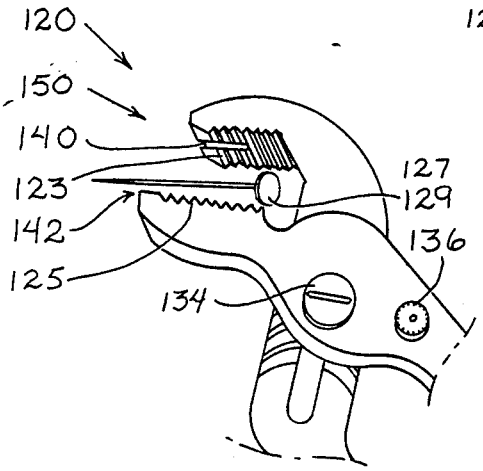
FIG. 2 is a perspective view of crescent jaws 120 for crescent pliers 100 showing nail puller 150 therein.
Figure 4:
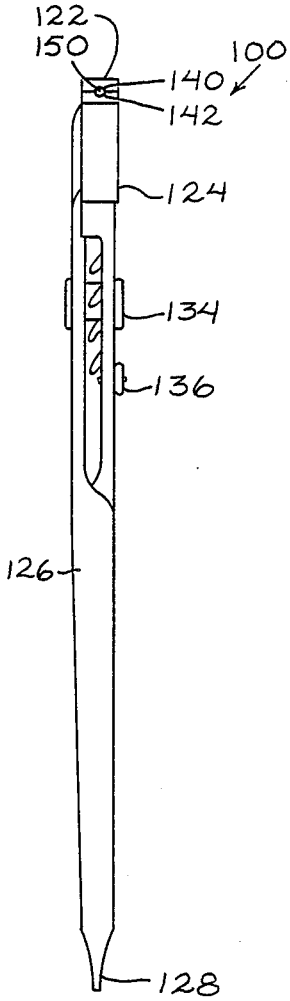
FIG. 4 is a side view of FIG. 3.

Referring now to FIG. 2 and FIG. 4, the crescent pliers 100 include a nail puller 150 having a first jaw slot 140 in first jaw gripper 123 and second jaw slot 142 in second jaw gripper 125. First jaw slot 140 and second jaw slot 142 can abut to grip a nail 127 or other item desired to be removed from board or for similar gripping purposes. First jaw slot 140 and second jaw slot 142, when abutting, can receive nail 127 with a nail head 129 resting between the first jaw gripper 123 and second jaw gripper 125. The slot formed between first jaw slot 140 and second jaw slot 142 is long enough to accomplish that grip. This slot structure is applicable to slip pliers 200 also.

Referring now to FIG. 5 and FIG. 6, the slip joint pliers 200 include a standard slip jaw 220 having a first slip side 222 and a second slip side 224 for the purpose of gripping a desired element. First slip side 222 extends from a first slip gripper 223 into a first slip handle 226. First slip gripper 223 is thus at one end of first slip side 222; while, at the other end of the first slip side 222, is a flat blade screwdriver 228.

By the same token, second slip side 224 extends from a second slip gripper 225 into a second slip handle 230. Second slip gripper 225 is thus at one end of second slip side 224 while, at the other end of the second slip side 224 on second slip handle 230 is a phillips screwdriver 232. Second slip gripper 225 and first slip gripper 223 serve to grip desired items.

Situated on second slip side 224 adjacent slip joint pivot 234 is a slip rotatable nut 236 secured thereto. The slip rotatable nut 236 is large enough to be turned by hand and can be used in threaded relation with second slip 224 and threadably moved downwardly to contact first slipside 222 in order to lock the slip joint pliers 200 in appropriate position to use either flat blade screwdriver 228 and phillips screwdriver 232.

The first jaw slot 140 and second jaw slot 142 of FIG. 2 and FIG. 4 may also be in slip joint pliers 200 for similar purposes.

With consideration of FIG. 7, a cross-section of FIG. 1 along Line 7—7 is shown. First jaw side 122 includes a first jaw brace 180. Second jaw side 124 includes a second jaw brace 182. First jaw brace 180 is between first jaw gripper 123 and first handle 126. Second jaw brace 182 is between second jaw gripper 125 and second handle 130. When first jaw brace 180 and second jaw brace 182 abut, first handle 126 and second handle 130 are substantially perpendicular to each other for use of the either screwdriver. Rotatable jaw nut 136 locks crescent pliers 100 in that open position.

This structure is also applicable to slip joint pliers 200. Referring again to FIG. 5 and FIG. 6, first slip brace 280 is between first slip gripper 223 and first slip handle 224. By the same token, second slip brace 282 is between second slip gripper 225 and second slip handle 226. When first slip brace 280 abuts second slip brace 282, first slip handle 224 is substantially perpendicular to second slip handle 226. Slip rotatable nut 236 locks slip pliers 200 in that open position for the use of either screwdriver.

This application—taken as a whole with the specification, claims, and abstract,—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of the disclosure herein and solely because of the disclosure herein, certain modifications of the pliers disclosed herein can become clear to a person having ordinary skill in this art. Such modifications are clearly covered hereby.

What is claimed and sought to be secured by Letters Patent of the United States, is:

1. A combination hand tool having a pliers function, a screwdriver function and a nail pulling function in one tool, wherein:

a. said pliers function is accomplished by providing a pliers having a first side and a second side pivotally connected by a pivot means;

b. said first side has a first jaw at one end thereof and a first handle at opposing end thereof;

c. said first jaw is oppositely disposed from said first handle;

d. said second side has a second jaw at one end thereof and a second handle at opposing end thereof;

e. said second jaw is oppositely disposed from said second handle;

f. said second jaw is movable to a position adjacent to said first jaw;

g. a locking means for locking said second jaw away from said first jaw is positioned adjacent said pivot means;

h. said screwdriver function includes a first screw driver means and a second screw driver means;

i. said first screw driver means is at an end of said first handle and oppositely disposed from said first jaw;

j. said second screw driver means is at an end of said second handle and oppositely disposed from said second jaw;

k. said locking means includes a fixing means and a bracing means; and l. said fixing means and said bracing means cooperate to lock said pliers in an open position for efficient use of said first screw driver means and said second screw driver means;

m. said bracing means includes a first jaw brace on said first jaw side and a second jaw brace on said second jaw side;

n. said first jaw brace is between said first jaw and said first handle;

o. said second jaw brace is between said second jaw and said second handle;

p. said first handle and said second handle are mutually and substantially perpendicular as said first jaw brace and said second jaw brace abut;

q. said fixing means includes a rotatable jaw bolt having a large enough to be turned by hand; and r. said rotatable jaw bolt is in threaded relation with said second jaw and threadably movable to contact said first jaw and lock said pliers in an open position to use either of said first screw driver means and said second screw driver means.

2. The combination hand tool of claim 1, wherein said first screw driver means is selected from the group consisting of a flat bladed screwdriver, a phillips screwdriver, and a star screwdriver.

3. The combination hand tool of claim 1, wherein said second screw driver means is selected from the group consisting of a flat bladed screwdriver, a phillips screwdriver, and a star screwdriver.

4. The combination hand tool of claim 1, wherein said first screw driver means is different from said second screw driver means.

5. The combination hand tool of claim 1, wherein said first screw driver means is the same as said second screw driver means.

6. The combination hand tool of claim 1, wherein:

a. said pliers includes a nail removal means for gripping a nail and remove said nail;

b. said nail removal means includes a first nail receiving slot in said first jaw and a second nail receiving slot in said second jaw; and c. said first jaw slot and said second jaw slot abut to grip said nail therebetween.

7. The combination hand tool of claim 1, wherein said pliers is a slip joint pliers.

8. The combination hand tool of claim 1, wherein said pliers is a crescent pliers.

* * * * *